US008365804B1

(12) United States Patent
Genovese et al.

(10) Patent No.: US 8,365,804 B1
(45) Date of Patent: Feb. 5, 2013

(54) PORTABLE INFLATABLE PROTECTIVE PARTITIONING SYSTEM

(75) Inventors: James A. Genovese, Street, MD (US); Patrick M. Nolan, Havre de Grace, MD (US); Win Van Basten, Hatboro, PA (US); Charles Ruppert, Massapequa Park, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 84 days.

(21) Appl. No.: 13/099,785

(22) Filed: May 3, 2011

(51) Int. Cl.
*A47G 5/00* (2006.01)

(52) U.S. Cl. ..... 160/351; 160/354; 160/377; 52/202; 454/170

(58) Field of Classification Search ..... 160/40, 160/44, 351, 354, 377; 52/2.18, 2.17, 202; 454/170, 169
See application file for complete search history.

(56) References Cited

U.S. PATENT DOCUMENTS

| | | | | |
|---|---|---|---|---|
| 2,028,060 | A * | 1/1936 | Eskell | 47/32.5 |
| 3,311,042 | A * | 3/1967 | Severson | 454/92 |
| 4,023,372 | A * | 5/1977 | Presler et al. | 405/132 |
| 4,040,210 | A * | 8/1977 | Land | 52/2.12 |
| 4,098,035 | A * | 7/1978 | Bessler | 52/2.12 |
| 4,366,977 | A * | 1/1983 | Davis et al. | 296/24.41 |
| 4,899,962 | A * | 2/1990 | Mueller | 244/129.2 |
| 7,963,075 | B2 * | 6/2011 | Howland | 52/202 |
| 2007/0181271 | A1 * | 8/2007 | Earnest | 160/368.1 |
| 2007/0218825 | A1 * | 9/2007 | Howery | 454/170 |
| 2009/0197518 | A1 * | 8/2009 | Reuther et al. | 454/170 |

* cited by examiner

*Primary Examiner* — Blair M. Johnson
(74) *Attorney, Agent, or Firm* — Ulysses John Biffoni

(57) ABSTRACT

An inflatable separation device and method of using the device to form a gas-impermeable barrier in a structural location such as a hallway. The device also provides a safe, effective passage across the barrier to form a concealed region for decontamination protocols. The inflatable separation device includes an inflatable support frame and a cover that envelops the support frame and forms an enclosed interior space when the support frame is inflated. An inflatable perimeter sealing bladder is disposed about the cover and adapted to form a seal between the cover and exterior surfaces of a structural space when the support frame and the sealing bladder are inflated.

15 Claims, 6 Drawing Sheets

PORTABLE INFLATABLE PROTECTIVE PARTITIONING SYSTEM

GOVERNMENTAL INTEREST

The invention described herein may be manufactured, used and licensed by or for the United States Government.

FIELD OF THE INVENTION

This invention relates to a device and methods for containing hazardous airborne contaminates and more specifically to a portable inflatable, protective partitioning system and method of operating the system for quick, efficient management of the airborne hazardous environment.

BACKGROUND OF THE INVENTION

The present invention particularly relates to a device to contain hazardous airborne contaminates released following the explosion and/or dissemination of Chemical Warfare Agents (CWA), Toxic Industrial Chemicals (TIC), smoke, and toxic by-products, and to be capable of quick, efficient management of the airborne hazardous environment. In order to ensure the safety of first responders, a protective barrier, effectively blocking the movement of the hazardous clouds, could be employed.

Previously, plastic sheets and tape were used to create barriers to the indoor spread of airborne materials at the site of an event. Setup of plastic barriers using tape is time consuming and labor intensive. In harsh conditions with high humidity, where soot or solids in the air are prevalent, the ability of the tape to adhere to surfaces is greatly reduced. These barricades do not allow for safe, effective passage across the barrier and likewise are deficient in providing a concealed region for decontamination protocols.

SUMMARY OF THE INVENTION

A portable, inflatable, protective, partitioning system (PIPPS) according to the present invention forms a barrier in a location such as a hallway and provides a safe, effective passage across the barrier to form a concealed region for decontamination protocols. The PIPPS includes an inflatable separation device that can be built from a high-grade, synthetic material, and is composed of an inflatable support section which contains two doorways separated by an inner compartment, and an outer, expandable bladder. Inflation of the inflatable separation device forms an enclosed interior space with a cover that envelops the inflated support frame and obstructs the progression of hazardous clouds by dividing a structural space with the cover into two areas, creating a partition blocking the majority of the vertical surface area of the hall. Subsequent inflation of the perimeter bladder between the cover and exterior surfaces of the structural space forms an air-tight seal against the walls. Utilization of the internal compartment of the support section allows first responders to enter and exit the contaminated areas. Positive or negative pressure can be used to purge the passageway of tainted air or allow first responders to proceed through while not allowing the hazardous cloud containing hazardous airborne contaminants that were released following the explosion and/or dissemination of Chemical Warfare Agents (CWA), Toxic Industrial Chemicals (TIC), smoke, and/or toxic by-products, to advance. The inflatable separation device is easy to inflate and operational within minutes of deployment, and portable enough to be moved to other locations quickly.

The portable inflatable protective partitioning system of the present invention is self supporting and self contained.

The portable inflatable protective partitioning system incorporates a rigid inner section that maintains the systems conformation and an inflatable bladder that allows for adaptation to a number of abstract applications, such as hallways, stairwells, tunnels or mobile tractor trailer systems.

The PIPPS provides a rapidly erected barrier with a substantially air-tight seal to mitigate the diffusion and convective transport of hazardous materials and air throughout a building structure. The addition of a portable airlock to a barrier is a large advantage to containment of smoke or airborne material, since it provides ingress and egress mechanisms that control the flow of the airborne environment. Furthermore, creating a barrier to allow decontamination and air purification before transport between separated sides can prevent the dermal and inhalation spread of contaminating substances. Another novel feature of the barrier is its use of a strong, inflatable frame to give it structural rigidity coupled with its inflatable bladder which can create an air-tight seal within a vast array of quadrilateral geometries to accommodate, e.g., hallways, stairwells, elevator shafts, and air ducts. This provides for a solid foundation and universal function, within applications which were previously ignored. The PIPPS is also physically non-taxing to implement, in that the majority of the work is done by a compressor, unlike in previous barrier installments, where bodily exertion was an acceptable consequence of the method. The hallway barrier provides a protective partition from hazardous materials, establishes an integrated decontamination effort, aids in casualty relief, and efficiently contains the incident.

According to the present invention, the PIPPS comprises an inflatable support frame, a cover that envelops the support frame and forms, an enclosed interior space when the support frame is inflated, and an inflatable perimeter sealing bladder disposed about the cover and adapted to form a seal between the cover and exterior surfaces of a structural space when the support frame and the sealing bladder are inflated. The inflatable support frame may include interconnected, inflatable tubes, wherein the interconnected inflatable tubes are constructed of material selected for durability, elasticity, high chemical and heat resistance and its ability to hold air. The interconnected inflatable tubes may include upper tubes, side tubes and bottom tubes interconnected so that the support frame generally forms a rectangular, box-like structure.

Also according to the present invention, the cover that envelops the support frame and forms an enclosed interior space may have front and rear walls and side walls and a ceiling and a floor. The cover may be formed of a material selected for durability, high chemical and heat resistance and its ability to prevent gas from flowing there through. The cover may be secured to the support frame so that upon inflation of the support frame, the cover forms generally rectangular front and rear walls, generally rectangular side walls and a generally rectangular ceiling and a generally rectangular floor. The front and, rear walls may each have a doorway that can be closed and sealed with a flap shaped door and through arms to change air within the interior-section.

Still further according to the present invention, the inflatable perimeter sealing bladder may be attached to the side walls and the ceiling of the cover. The inflatable perimeter sealing bladder may also be removably attached to the side walls and the ceiling of the cover. When inflated the inflatable perimeter sealing bladder forms an airtight seal against the surfaces of the structural space being divided by the cover. The present invention further includes a system for inflating the inflatable support frame, and the inflatable perimeter sealing bladder, including a means for directing compressed air through the inlet of a first pressure relief valve to inflate the support frame to a first required pressure and a means for directing compressed air from the first pressure relief valve and through a second pressure relief valve to inflate the bladder and vent extra air flow so that the bladder remains at a second required pressure adapted to form the seal between the cover and exterior surfaces. This inflation system may entail directing compressed air through the inlet of a pressure relief valve and then through a first check valve into an inflatable frame so that the frame is inflated to a first required pressure such that a cover that envelops the support frame forms an enclosed interior space. The compressed air is then directed from the first pressure relief valve and through a second required pressure relief valve and then through a second check valve to inflate an inflatable bladder to a second pressure and vent extra-air flow so that the bladder remains at the second pressure. When inflated according to this system the bladder forms a seal between the cover and exterior surfaces of a structural space. The means for directing compressed air according to this system may be an air compressor.

The present invention further encompasses a method of sealing off a structural space by inflating an inflatable support frame having a plurality of interconnected, inflatable tubes, forming an enclosed interior space with a cover that envelops the inflated support frame, dividing the structural space with the cover into two areas, and inflating a perimeter sealing bladder disposed between the cover and exterior surfaces of the structural space to form an air-tight seal between the two areas of the structural space separated by the cover.

Further according to the present invention, the step of inflating the inflatable support frame includes inflating inflatable upper tubes, side tubes and bottom tubes interconnected so that the inflatable support frame generally forms a rectangular, box-like structure.

Still further according to the present invention, the enclosed interior space is formed with a cover that envelops and is secured to the inflated support frame so that upon inflation of the support frame, the cover forms generally rectangular front and rear walls, generally rectangular side walls and a generally rectangular ceiling and a generally rectangular floor.

Yet further according to the present invention, inflating the inflatable support frame and the inflatable sealing bladder, comprises the steps of: directing compressed air through the inlet of a first pressure relief valve to inflate the support frame to a first pressure; and directing compressed air from the first pressure relief valve and through a second pressure relief valve to inflate the bladder and vent extra air flow so that the bladder remains at a second pressure adapted to form the seal between the cover and exterior surfaces.

Also according to the present invention, inflating the inflatable support frame and the inflatable sealing bladder, comprises the steps of: directing compressed air from an air compressor to inflate the support frame to a first pressure; and directing compressed air from the air compressor to inflate the bladder to a second pressure adapted to form the seal between the cover and exterior surfaces.

BRIEF DESCRIPTION OF THE DRAWINGS

The operation, and advantages of the present invention will become apparent upon consideration of the description herein taken in conjunction with the accompanying figures. The figures are intended to be illustrative, not limiting. Certain elements in some of the figures may be omitted, or illustrated not-to-scale, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

Although the invention is generally described in the context of these preferred embodiments, it should be understood that the figures are not intended to limit the spirit and scope of the invention to these particular embodiments.

Figure 1:
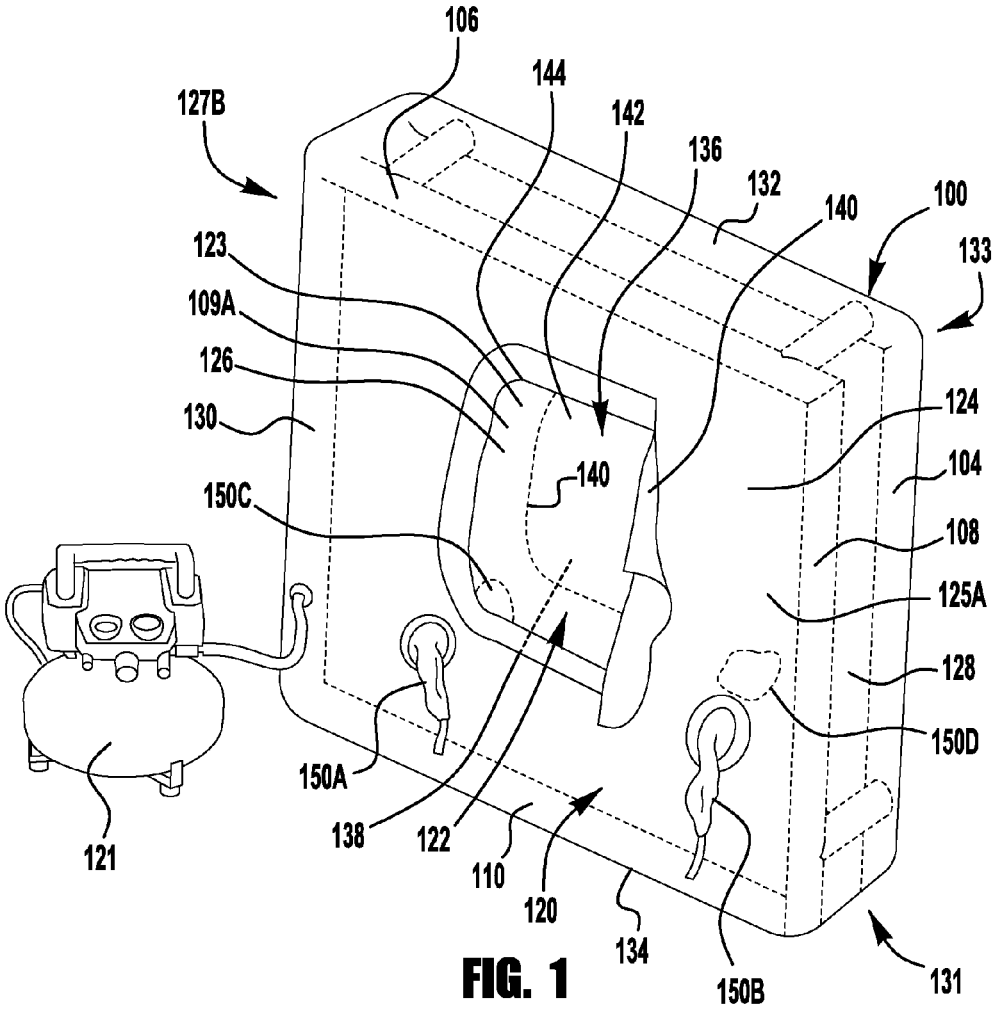

The figures submitted include the following:

FIG. 1 is a perspective view showing the portion of the portable, inflatable separation device, without the bladder in an assembled and inflated condition, in accordance with the present invention.

Figure 1A:
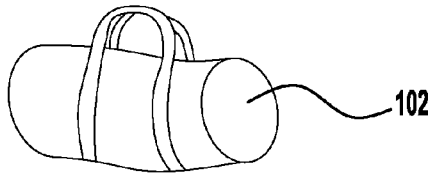

FIG. 1A is an illustration of a bag to carry and store the portable, inflatable separation device, in accordance with the present invention.

Figure 2:
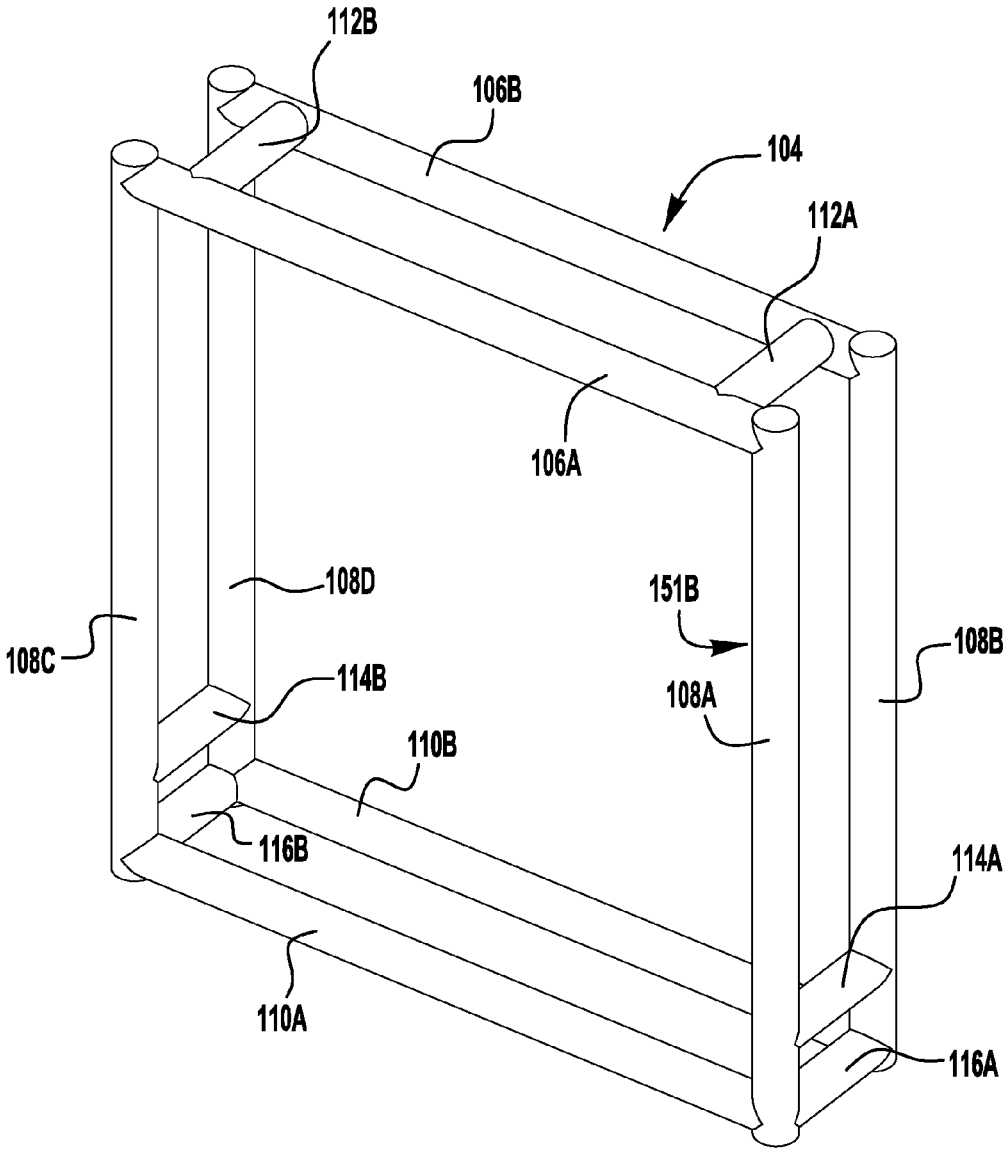

FIG. 2 shows the interior support structure of the portable, inflatable separation device, in accordance with the present invention.

Figure 3:
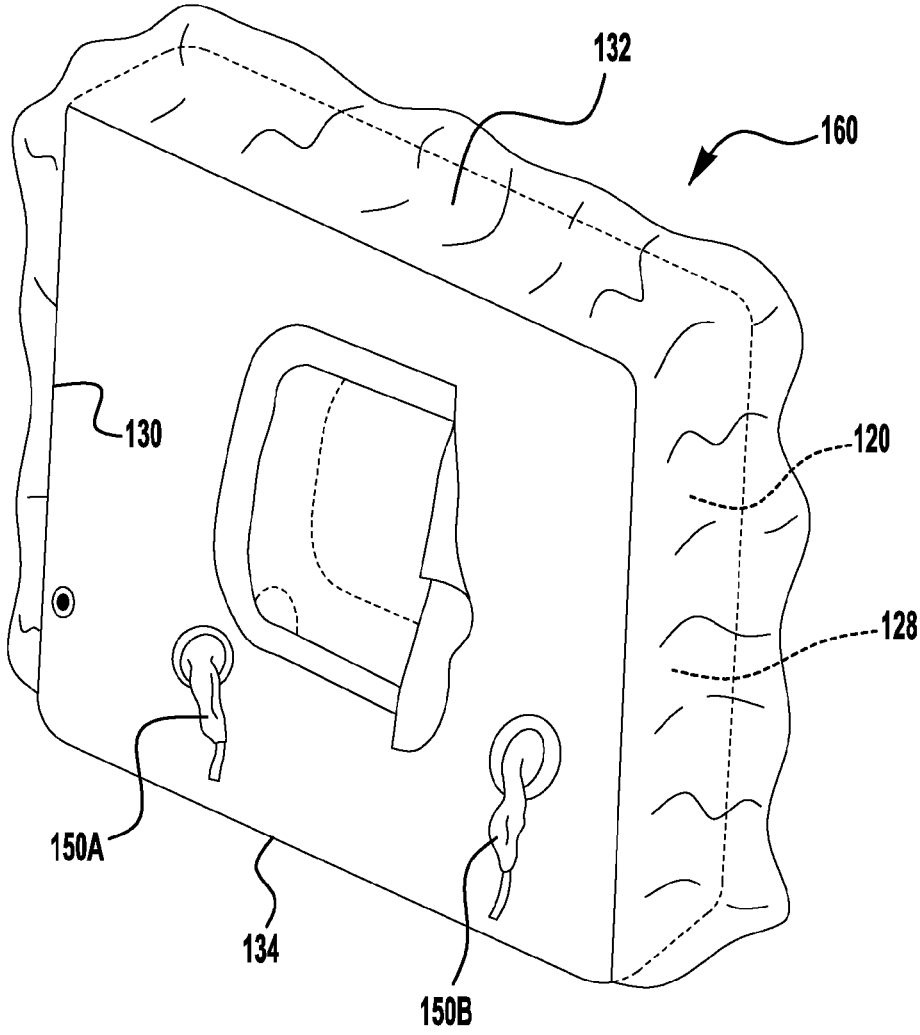

FIG. 3 is a perspective view showing the portable, inflatable separation device assembled with the bladder in an uninflated state, in accordance with the present invention.

Figure 4:
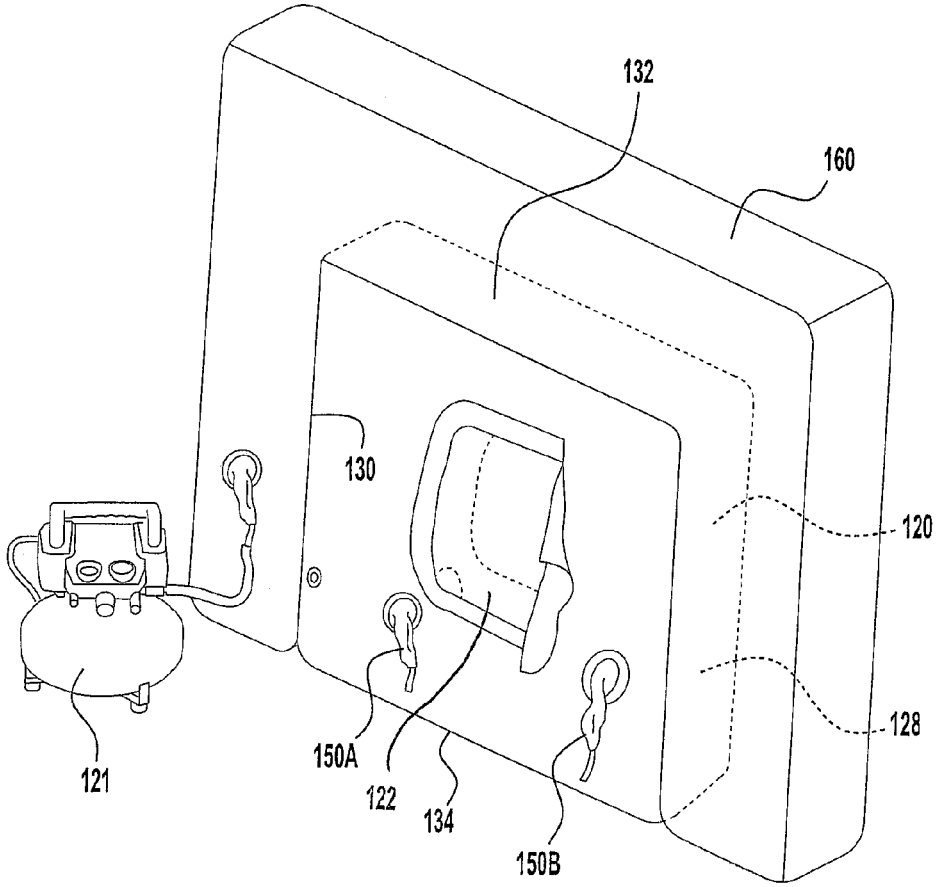

FIG. 4 is a perspective view showing the portable, inflatable separation device assembled, inflated and attached to a compressor, in accordance with the present invention.

Figure 5:
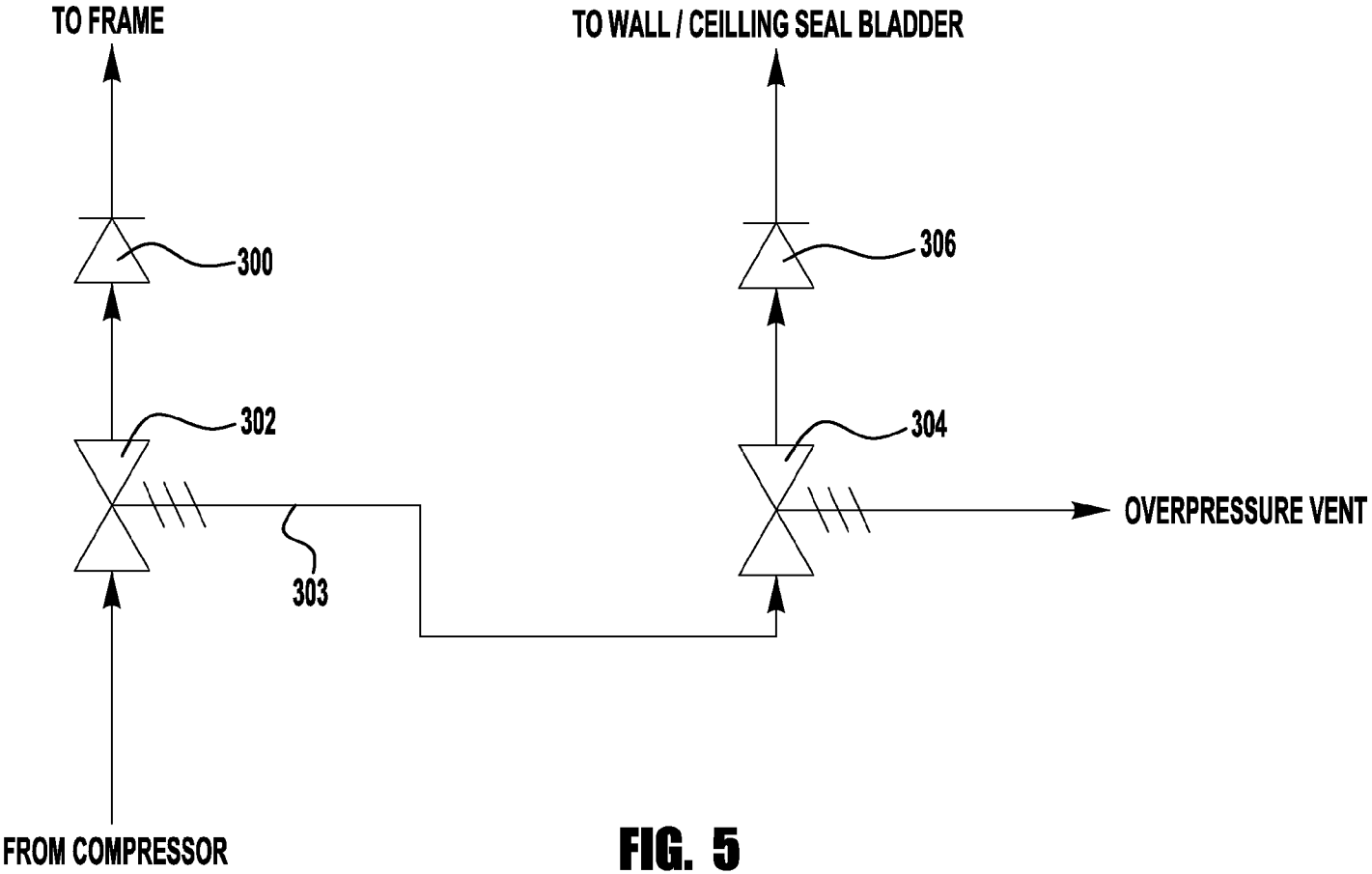

FIG. 5 is a schematic representation showing an embodiment of the inflation system for inflating both the inflatable separation device and the bladder, in accordance with the present invention.

Figure 6:
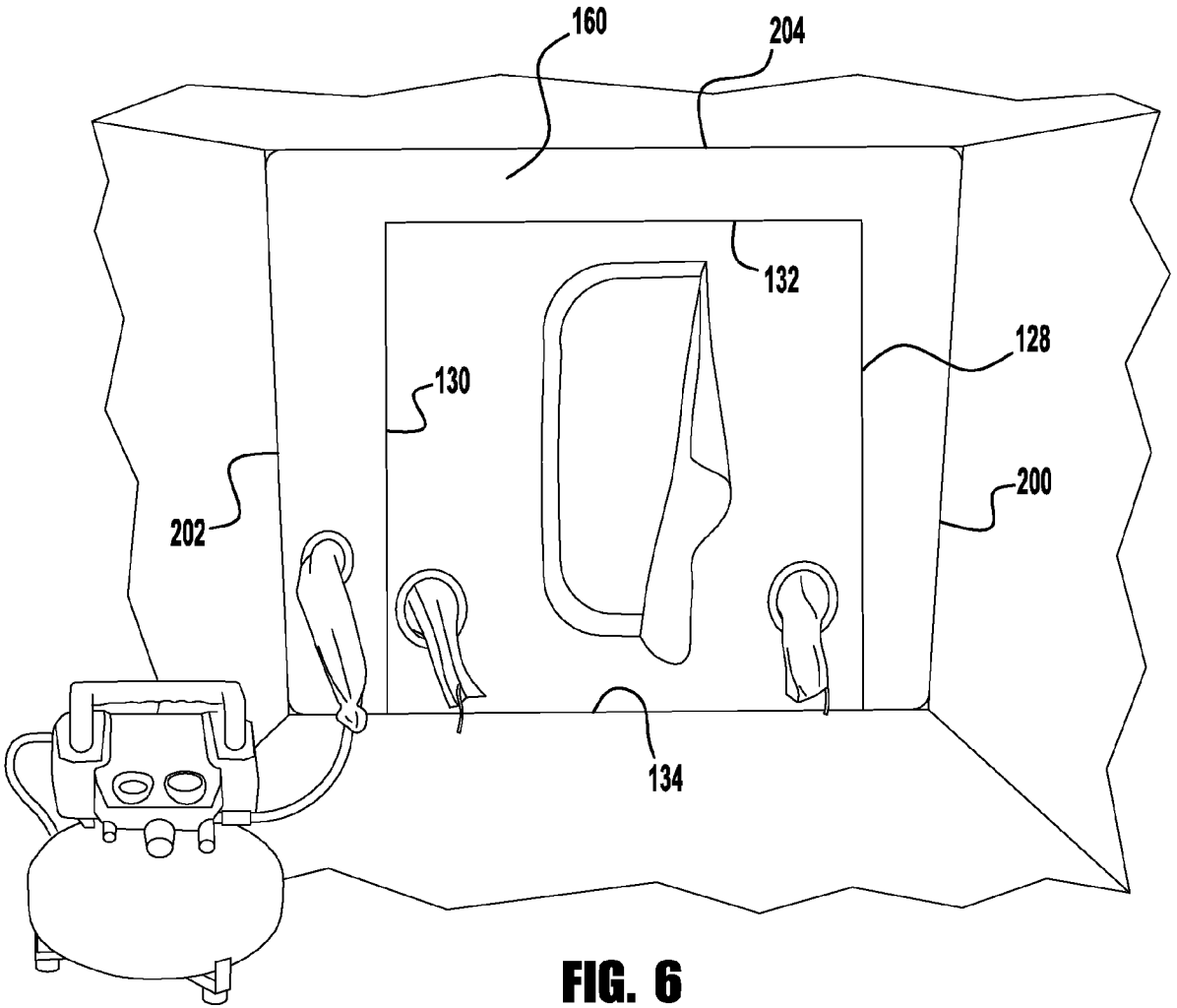

FIG. 6 is a plan view showing the portable, inflatable separation device assembled and engaged in a hallway area, in accordance with the present invention.

DETAILED DESCRIPTION OF PREFERRED EMBODIMENTS OF INVENTION

Referring to FIG. 1, there is illustrated a perspective view of the portable, inflatable, protective; partitioning system (PIPPS) 100 of the present invention in an inflated state, but without the outside bladder for easier understanding of the invention. PIPPS 100 can be stored and carried in a bag 102 as shown in FIG. 1A. The PIPPS 100 can be easily transported and unpacked from carrying case 102 at the location where it is needed. Initially, PIPPS 100 is laid out flat on the floor within the confines of the space, such as a hallway, to be contained.

PIPPS 100 includes an inflatable support frame 104, as shown in detail in FIG. 2 and described hereinafter, consisting of a plurality of rugged, inflatable upper tubes 106*a*,106*b*, inflatable side tubes 108*a*,108*b*,108*c*,108*d*, and inflatable bottom tubes 110*a*, 110*b*. In addition, there are upper inflatable connector tubes 112*a*,112*b*, side inflatable connector tubes 114*a*, 114*b* and bottom inflatable connector tubes 116*a* and 116*b*. All of the inflatable tubes are secured and interconnected in a manner that the same air source can be used to inflate all of them simultaneously. The inflatable upper tubes 106*a*,106*b*, inflatable side tubes 108*a*,108*b*,108*c*,108*d*, inflatable bottom tubes 110*a*, 110*b* are interconnected so that support frame 104 is generally in the shape of a rectangular, box-like structure. In one embodiment of the invention, the support frame 104, when fully inflated, measures three feet wide, seven feet high and ten feet wide. Upon inflation, support frame 104 supports PIPPS 100, preferably within an enclosed structural space such as for example, a room, corridor or hallway, ultimately to form a barrier between areas of the structural space located on opposite sides of the support frame. In accordance with the present invention, the support frame expands upon inflation to cover the majority of the surface area for the opening of the enclosed structural space, leaving only the crevices and unique geometries for the bladder, described in detail, hereinafter, to expand and fill.

As shown in FIG. 2 and discussed hereinafter, it can be understood that the support frame 104 forms a continuous network of interconnected tubes such that all tubes can be fully inflated by the channeling of air through a point on any of the tubes. The inflatable tubes of the support frame 104 can be constructed of material selected for durability, elasticity, high chemical and heat resistance, and its gas impermeability.

PIPPS 100, as shown in FIG. 1, has an external cover 120 constructed of a material that completely covers the support frame 104 to form an enclosed interior space 122 when the frame is inflated. The external cover 120 can be permanently attached to the support frame 104 so that upon inflation of the support frame, the external surface forms generally rectangular front and rear walls 124, 126, respectively, generally rectangular side walls 128,130, respectively, top wall or ceiling 132 and bottom wall or floor 134. The material of the cover can be constructed of a material selected for durability, high chemical and heat resistance and its gas impermeability.

In the front and rear walls 124, 126, respectively, which form the two sides of the barrier 100, are located doorways 136,138. Each of the doorways 136,138 can be closed and sealed with flap shaped door 140,142, respectively. The doors can be closed and sealed with any means, such as a zipper 144, 146, to create an airtight barrier that securely seals the one environment on one side of the barrier 100 from the environment on the other side of the barrier 100.

When either door 140, 142 is zippered shut, a barrier exists between the front and rear walls 124, 126 of the PIPPS 100. Together, the doors 124, 126, form an interior air lock within the confines of the existing front and rear walls 124, 126, respectively, generally rectangular side walls 128,130, respectively, top wall or ceiling 132 and a bottom wall or floor 134 to allow people passage between sides without allowing undesirable gases on one side of the PIPPS 100 to pass to the other side.

Also located in the front and rear walls 124, 126 are a plurality of pass through arms 150A, 150B on front wall 124 and 150C-150D (not shown) on rear wall 126. The pass through arms 150A, 150B, 150C,150D communicate with the enclosed interior space 122 of PIPPS 100 while a barrier remains between the interior and exterior environments. The pass through arms are shaped to allow for changing pressure within the interior chamber 122 or insertion of hoses or cables into the interior chamber, while preserving a sealed environment.

As shown in FIG. 3, disposed around the side walls 128, 130 and across the top wall 132 of the external cover 120 of PIPPS 100 is an inflatable perimeter sealing bladder 160, adapted to form a seal between the cover and exterior surfaces of a structural space when the support frame and the sealing bladder are inflated. The perimeter sealing bladder 160 is permanently attached to the side walls 128, 130 and the ceiling 132 by any means such as but not limited to a sealing cement or glue. It is also within the terms of the present invention to removably mount the bladder to the external cover 120 of PIPPS 100 so that, for example, it can, be left off the device in the event it is not necessary for a given opening's geometry.

Bladder 160 is constructed of such material that is specifically selected for durability, elasticity, high chemical and heat resistance and its ability to hold air and form an airtight seal against the surfaces of the walls 124, 126 and the ceiling of a structural space being divided by the cover, as shown in FIG. 6. The perimeter sealing bladder 160 is shaped as a three-sectioned threshold or entrance of such dimensions as to conform tightly to the side and upper walls 128, 130, 132, respectively, of the support structure 104 in its interior dimensions and to conform tightly to the wall surfaces 200, 202 and ceiling 204 of a structural space selected from the group comprising rooms, hallways, corridors whereby the cover 120 divides the structural space into two separate areas. In cross-section, the perimeter sealing bladder 160 can be shaped as a circular or oval tube, as a squared off tube, or can even feature a concave face, as best to conform to the surface of the support structure 104.

The present invention-anticipates various means of inflating the perimeter sealing bladder 160. In one embodiment, the air compressor 121 is first connected to the support frame 104 and the support frame is inflated as shown in FIG. 2. Then, the air compressor is disconnected from the support frame 104 and connected to the sealing bladder 160. The sealing bladder 160 is inflated until it is in sealing contact with the wall surfaces 200, 202 and ceiling 204 of a hallway, room or other space as generally shown in FIG. 6.

In an alternative embodiment of the invention, the support frame 104 and perimeter sealing bladder 160 can be inflated simultaneously using separate compressors 121 if available.

It is also within the terms of the present invention for a compressed air cylinder or foot pump to be used in place of the air compressor. This is advantageous in that it removes the electrical requirements and adds flexibility to the system.

In an alternative embodiment as shown generally in FIG. 5, the air compressor 121 directs compressed air through the inlet of pressure relief valve 302 and through the check valve 300 into frame 104. The check valve 300 prevents pressure relief valve 302 from emptying the frame 104. The relief exit 303 from pressure relief valve 302 is diverted to the inlet of pressure relief valve 304, and causes the frame 104 to inflate to a first required pressure. Pressure relief valve 304 is set to the required inflation pressure for the sealing bladder 160. Once the bladder 160 is inflated to a second required pressure, pressure relief valve 304 vents extra air flow to a vent. A check valve 306 in the line from the pressure relief valve 304 to the bladder 160 prevents pressure relief valve 304 from emptying the bladder. The bladder 160 requires constant inflation to maintain a seal, so if the pressure in the sealing bladder drops below a pre-established set point, pressure relief valve 304 will close, ensuring continued inflation of the sealing bladder.

Once PIPPS 100 has been inflated, the compressor 121 is left on to maintain the seal and a secondary blower/filter (not shown) can be used in conjunction with the pass through arms 150A, 150B, 150C and 150D to clean air which passes between the two doors 138,140, preventing undesirable material from the contaminated side of the hall from infecting the clean side of the hall, as people pass through the doors. In other words, the barrier can act as an airlock so that a person can open one door, step into the interior area and then close the door; and then permit the air to purge from the interior area before exiting through the other door.

Referring to FIG. 4, the interior section or space 122 can also be used as a decontamination room, allowing individuals to pass from the contaminated side, into the decontamination room, to go through decontamination protocols, such as bleach and physical removal, and then pass safely into the clean side. The pressure inside both the support frame 104 and perimeter sealing bladder 160 can be monitored using gauges (not shown) integrated into the framework of the PIPPS 100, allowing users to verify the system's inflatable integrity. Once an incident has been contained, and need for the PIPPS has ceased, it can be cleaned/decontaminated via standard procedures, and packaged back into its carrying case 102 for future deployment.

The PIPPS 100 provides a rapidly erected barrier formed by the cover and sealing bladder in a structural space such as a room, corridor or hallway to separate two areas of the structural space with a relatively air-tight seal to mitigate the diffusion and convective transport of hazardous materials and air between the two areas and necessarily throughout a building structure. The addition of a portable airlock to a barrier is a large advantage to containment of smoke or airborne material, since it provides ingress and egress mechanisms that control the flow of the airborne environment. Furthermore, creating a barrier to allow decontamination and air purification before transport between separated sides can prevent the dermal and inhalation spread of contaminating substances. Another function of the PIPPS 100 could be to prevent oxygen rich air on one side of the barrier to a fire source on an opposite side of the barrier.

Another novel feature of the barrier is its use of a strong, inflatable frame to give it structural rigidity coupled with its inflatable bladder which can create an air-tight seal within a vast array of quadrilateral geometries to accommodate, e.g., hallways, stairwells, elevator shafts, and air ducts. In the context of the present invention, air-tight also means gas-tight. This provides for a solid foundation and universal function, within which applications were previously ignored. The PIPPS is also physically non-taxing to implement, in that the majority of the work can be done by a compressor, unlike in previous barrier installments, where bodily exertion was an acceptable consequence of the method. In sum, the hallway barrier of the present invention provides a protective partition from hazardous materials, establishes an integrated decontamination effort, aids in casualty relief, and efficiently contains the incident.

Although the invention has been shown and described with respect to a certain preferred embodiment or embodiments, certain equivalent alterations and modifications will occur to others skilled in the art upon the reading and understanding of this specification and the annexed drawings. In particular regard to the various methods and apparatus used in managing airborne hazardous environments, the terms (including a reference to a "means") used to describe such management are intended to correspond, unless otherwise indicated, to any methods or apparatus which perform the specified management of airborne hazardous environments (i.e., that is functionally equivalent), even though not equivalent to the disclosed methods or apparatus which performs the function in the herein illustrated exemplary embodiments of the invention. In addition, while a particular feature of the invention may have been disclosed with respect to only one of several embodiments, such a feature may be combined with one or more features of the other embodiments as may be desired and advantageous for any given or particular application.

What is claimed is:

1. An inflatable separation device, comprising:

an inflatable support frame;

a cover that envelops the support frame and forms an enclosed interior space when the support frame is inflated; and an inflatable perimeter sealing bladder disposed about the cover and adapted to form a seal between the cover and exterior surfaces of a structural space when the support frame and the sealing bladder are inflated, wherein the cover has front and rear walls, side walls, a ceiling and a floor, and wherein the cover is secured to the support frame so that upon inflation of the support frame the cover forms generally rectangular front and rear walls, generally rectangular side walls, a generally rectangular ceiling and a generally rectangular floor.

2. The inflatable separation device of claim 1, wherein the inflatable support frame comprises interconnected, inflatable tubes.

3. The inflatable separation device of claim 2, wherein the interconnected inflatable tubes are constructed of material selected for durability, elasticity, high chemical and heat resistance and its gas impermeability.

4. The inflatable separation device of claim 2, wherein the interconnected inflatable tubes include upper tubes, side tubes and bottom tubes interconnected so that the support frame generally forms a rectangular, box structure.

5. The inflatable separation device of claim 1, wherein the cover is formed of a material selected for durability, high chemical and heat resistance and its gas impermeability.

6. The inflatable separation device of claim 1, wherein the front and rear walls include a doorway that can be closed and sealed with a flap shaped door and through arms to change air within the interior section.

7. The inflatable separation device of claim 1, wherein the inflatable perimeter sealing bladder is attached to the side walls and the ceiling of the cover.

8. The inflatable separation device of claim 7, wherein the inflatable perimeter sealing bladder is removably attached to the side walls and the ceiling of the cover.

9. The inflatable separation device of claim 7, wherein the inflatable perimeter sealing bladder is inflated to form an airtight seal against the surfaces of the structural space being divided by the cover.

10. The inflatable separation device of claim 1, further including a system for inflating the inflatable support frame and the inflatable perimeter sealing bladder, comprising:

means for directing compressed air through the inlet of a first pressure relief valve to inflate the support frame to a first required pressure; and means for directing compressed air from the first pressure relief valve and through a second pressure relief valve to inflate the bladder and vent extra air flow so that the bladder remains at a second required pressure adapted to form the seal between the cover and exterior surfaces.

11. The inflatable separation device of claim 1, further including a system for inflating the inflatable support frame and the inflatable perimeter sealing bladder, comprising:

means for directing compressed air through the inlet of a pressure relief valve and then through a first check valve into an inflatable frame so that the frame is inflated to a first required pressure whereby a cover that envelops the support frame forms an enclosed interior space;

means for directing compressed air from the first pressure relief valve and through a second required pressure relief valve and then through a second check valve to inflate an inflatable bladder to a second pressure and vent extra air flow so that the bladder remains at the second pressure so as to form a seal between the cover and exterior surfaces of a structural space.

12. The inflatable separation device of claim 11, wherein the means for directing compressed air is an air compressor.

13. A method of sealing off a structural space, comprising the steps of:

inflating an inflatable support frame, wherein said inflatable support frame has a cover that envelops the inflated support frame to form an enclosed interior space when said support frame is inflated;

dividing the structural space with the cover into two areas upon inflation of the support frame; and inflating a perimeter sealing bladder disposed between the cover and exterior surfaces of the structural space to form a gas-tight seal between the two areas of the structural space separated by the cover, wherein the step of inflating the inflatable support frame includes inflating a plurality of interconnected, inflatable tubes and wherein the step of inflating the inflatable support frame includes inflating inflatable upper tubes, side tubes and bottom tubes interconnected so that the inflatable support frame generally forms a rectangular box structure and wherein upon inflation of the support frame the cover forms generally rectangular front and rear walls, generally rectangular side walls, and a generally rectangular ceiling and floor.

14. The method of claim 13, wherein the steps of inflating the inflatable support frame and the inflatable sealing bladder, comprises the steps of:

directing compressed air through the inlet of a first pressure relief valve to inflate the support frame to a first pressure; and directing compressed air from the first pressure relief valve through a second pressure relief valve to inflate the bladder and venting extra air flow so that the bladder remains at a second pressure adapted to form the seal between the cover and exterior surfaces.

15. The method of claim 14, wherein the steps of inflating the inflatable support frame and the inflatable sealing bladder, comprises the steps of:

directing compressed air from an air compressor to inflate the support frame to a first pressure; and directing compressed air from the air compressor to inflate the bladder to a second pressure adapted to form the seal between the cover and exterior surfaces.

* * * * *